United States Patent [19]

Vavra

[11] Patent Number: 4,574,998

[45] Date of Patent: Mar. 11, 1986

[54] OPEN-ENDED CARTON AND CARTON BLANK

[75] Inventor: Paul P. Vavra, Kohler, Wis.

[73] Assignee: Kohler Co., Kohler, Wis.

[21] Appl. No.: 636,686

[22] Filed: Aug. 1, 1984

[51] Int. Cl.[4] ..... B65D 5/04

[52] U.S. Cl. ..... 229/40; 206/45.16; 206/320; 229/87 H

[58] Field of Search ..... 206/319, 320, 349, 45.14, 206/45.15, 45.16, 45.33, 44, 486–490, 565, 480, 482, 45.19, 424; 229/40, 33, 30, 87 H, 87 R, 29 B

[56] References Cited

U.S. PATENT DOCUMENTS

| | | | |
|---|---|---|---|
| 1,906,337 | 5/1933 | Rutledge | 229/29 B |
| 2,013,346 | 9/1935 | Gomes | 206/320 |
| 2,076,844 | 4/1937 | Holmes | 229/29 B |
| 2,163,045 | 6/1939 | Lavere | 229/37 |
| 2,314,491 | 3/1943 | Greenberg | 206/319 X |
| 2,397,041 | 3/1946 | Pantalone | 229/6 |
| 2,509,447 | 5/1950 | Prawdzik | 229/30 |
| 2,570,946 | 10/1951 | Hennessey | 229/87 H |
| 3,084,790 | 4/1963 | Vander Lugt | 206/45.14 |
| 3,232,513 | 2/1966 | Maio | 229/14 |
| 3,271,357 | 9/1966 | Burt | 206/45.33 |
| 3,361,330 | 1/1968 | Arneson | 229/39 |
| 3,380,644 | 4/1968 | D'Alessio | 229/40 |
| 3,481,453 | 12/1969 | Shreve, III et al. | 206/349 X |
| 3,521,812 | 7/1970 | Moers et al. | 229/39 |
| 3,575,285 | 4/1971 | Kahn | 206/44 R |
| 3,664,494 | 5/1972 | Mergens | 206/44 R |
| 3,693,866 | 9/1972 | Struble | 229/39 B |
| 3,705,681 | 12/1972 | Rossi et al. | 229/40 |
| 3,741,380 | 6/1973 | Carney | 206/45.14 |
| 3,820,708 | 6/1974 | Sieffert | 229/40 |
| 3,836,066 | 9/1974 | Del Priore et al. | 229/40 |
| 3,871,572 | 3/1975 | Skaggs | 229/40 |
| 3,964,669 | 6/1976 | Sontag et al. | 229/40 |
| 4,006,822 | 2/1977 | McCall | 206/424 |
| 4,019,672 | 4/1977 | Giannini | 229/14 C |
| 4,071,140 | 1/1978 | Rattner | 206/45.15 |
| 4,375,261 | 3/1983 | Kitchell | 206/320 |
| 4,493,453 | 1/1985 | Le Drew | 229/17 B |

FOREIGN PATENT DOCUMENTS

| | | | |
|---|---|---|---|
| 2636454 | 2/1978 | Fed. Rep. of Germany | 229/40 |
| 307537 | 7/1968 | Sweden . | |

*Primary Examiner*—George E. Lowrance
*Assistant Examiner*—Bryon Gehman
*Attorney, Agent, or Firm*—Quarles & Brady

[57] ABSTRACT

An open-ended shipping carton with an integral tray and a carton blank for forming such a carton are disclosed. In one embodiment there is provided a tray panel which extends across the base of the article, a first side panel connected to a side edge of the tray panel and extending across a side of the article, a top panel connected to a top edge of the first side panel and extending across the top of the article, a second side panel connected to the opposite side edge of the top panel and extending across the side of the article which is opposite the first side, and a bottom panel connected to the bottom edge of the second side panel. The bottom panel extends under the tray panel and is secured so that the carton fits closely around the top, sides and base of the article. A pair of end retainers are formed by cuts and scoring in the tray panel and are accordion-folded and spaced apart to receive a base of an article between them so as to permit visual inspection through a carton open end of at least a portion of the interior of the carton which is inward of the retainers. The carton is especially suitable for shipping heavy and fragile articles such as toilets.

4 Claims, 13 Drawing Figures

FIG. 1
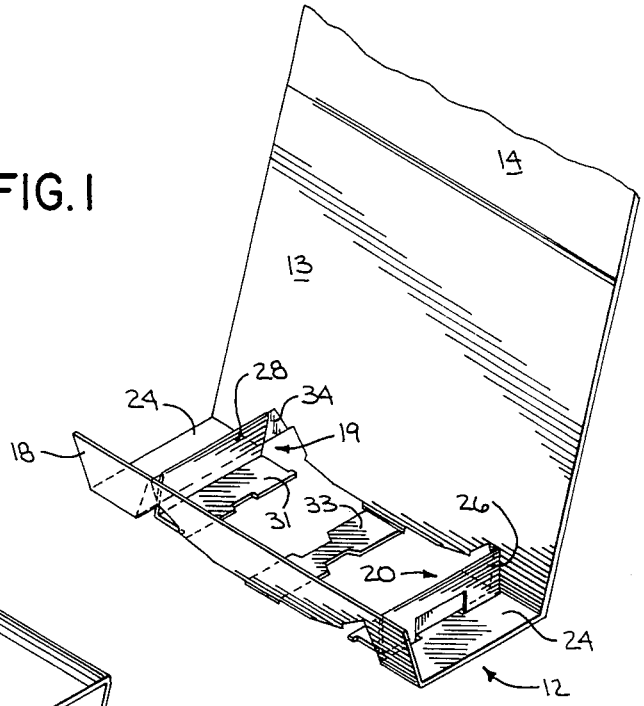
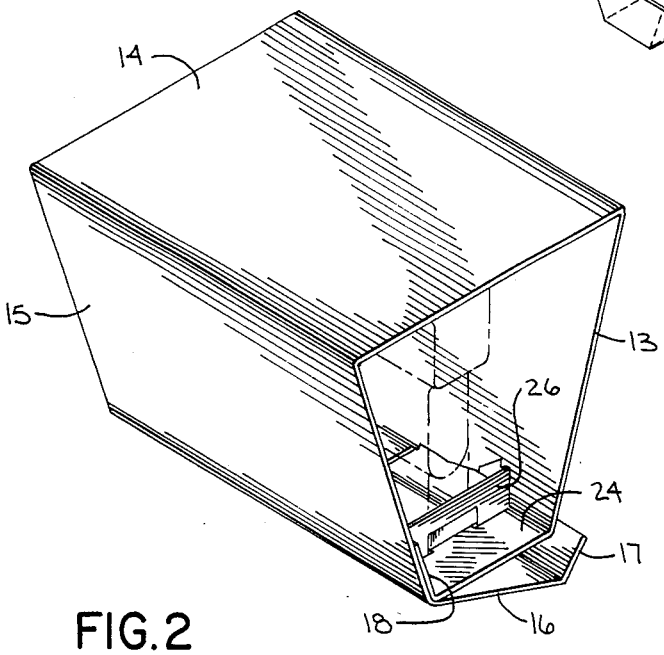
FIG. 2
FIG. 13
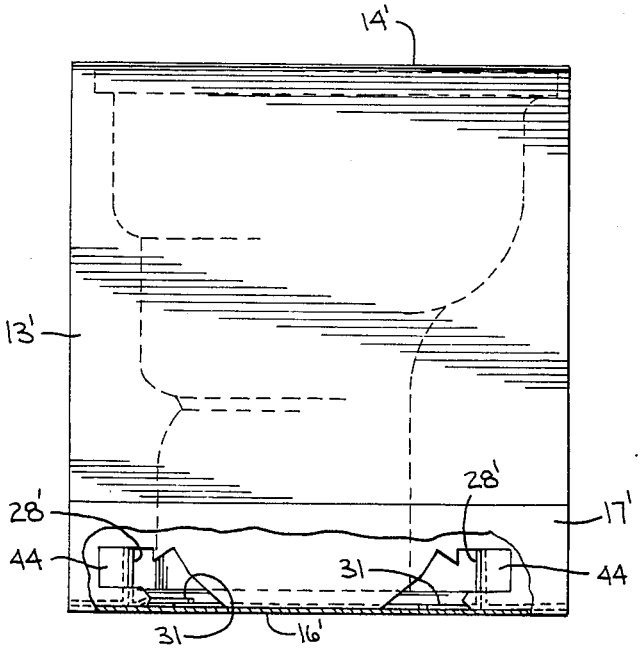

FIG. 3
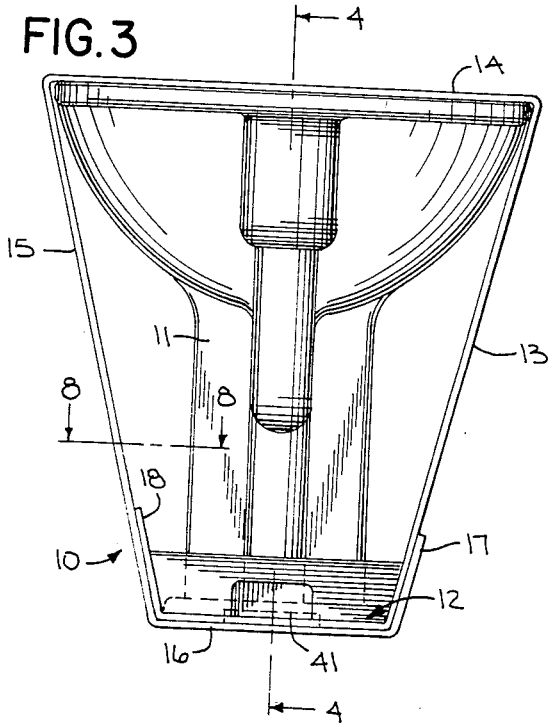
FIG. 4
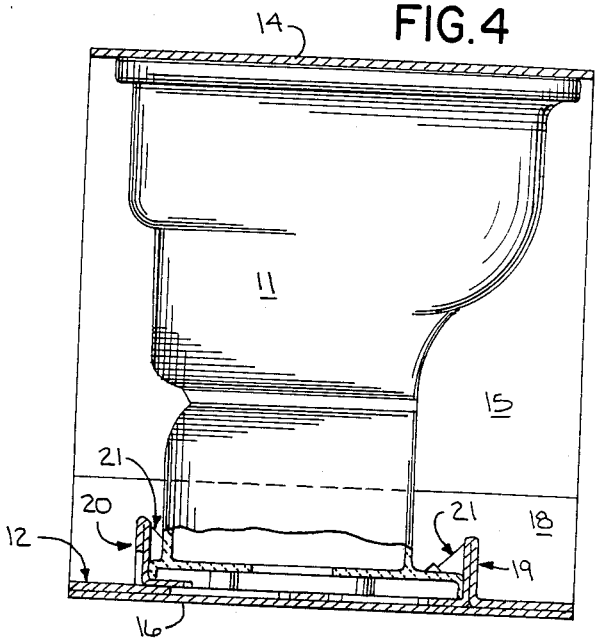
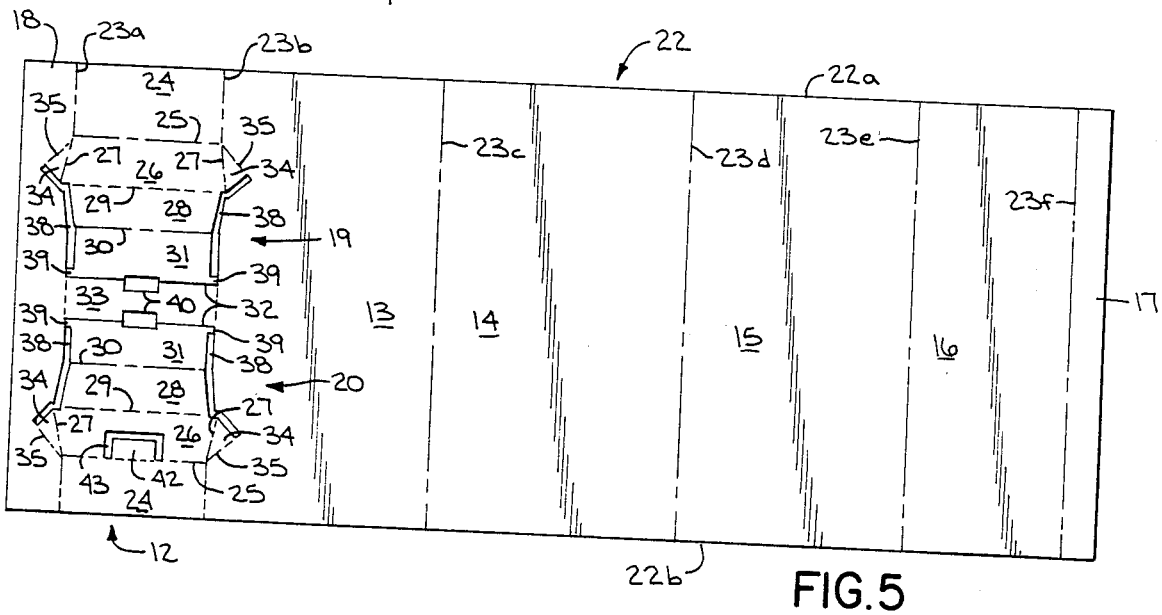
FIG. 5
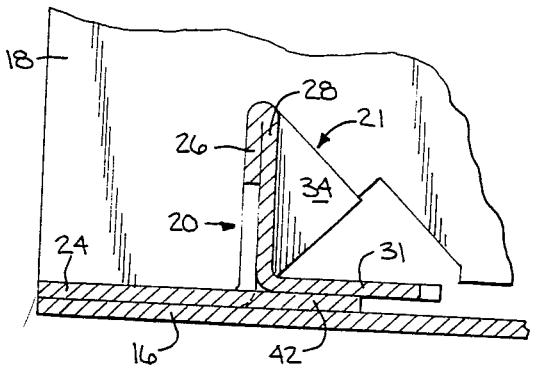
FIG. 6
FIG. 7
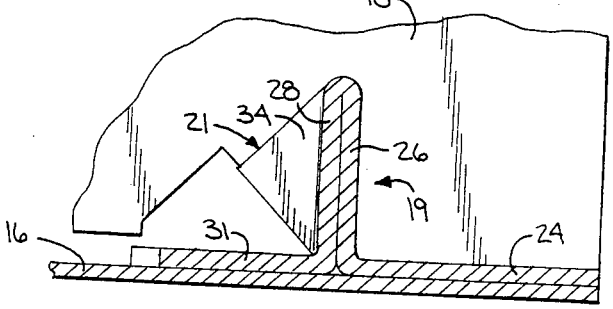

OPEN-ENDED CARTON AND CARTON BLANK

BACKGROUND OF THE INVENTION

A. Field of the Invention

The present invention relates to an open-ended shipping carton for an article such as a toilet. It also relates to a carton blank for forming such cartons.

B. Description of the Art

The combination of weight and fragility of products such as toilets resulted in certain shipping problems. One problem was that because most prior art containers for such items were fully enclosed, weight was sometimes mistakenly equated with ruggedness, so that a heavy carton would on occasion not be handled with the required care. While warnings were usually provided on such cartons, they were often either not believed or simply ignored.

Another problem was that because of the fully enclosed nature of these containers, little discouragement could be given to careless handlers and assessing responsibility for breakage was difficult. In this regard, whether damage had occurred to a fully enclosed toilet was normally not apparent until the container was opened.

Yet another problem was that toilets and some other products are usually wider at the top than at the base, so that a carton must be sized to accommodate the wider top. Shipping spacers were therefore usually required to surround the base of the toilet and abut the side and end walls of the carton so that the side and end walls would restrain the toilet from sliding or tipping inside the carton. Moreover, the blanks for such cartons often required large sheets of packaging material and were quite expensive to make. It can therefore be seen that a need has existed for an improved packing carton and carton blank for items like toilets.

SUMMARY OF THE INVENTION

The invention relates to an open-ended shipping carton and a carton blank for forming such cartons. In one aspect, the shipping carton has a tray panel which is suitable to extend across the base of the article to be shipped and a first side panel which is connected to the tray panel adjacent a side edge of the tray panel and is suitable to extend across a first side of the article. A top panel is connected to the first side panel adjacent a top edge of the first side panel and is suitable to extend across the top of the article. A second side panel is connected to the top panel adjacent a side edge of the top panel which is opposite the first side panel and is suitable to extend across the side of the article which is opposite from the first side. A bottom panel that is suitable to extend at least partially under the bottom of the tray panel is connected to the second side panel adjacent its bottom edge and is secured so that the carton is suitable to fit around the top, first and second sides and base of the article. A pair of end retainers are formed by cuts and fold lines in the tray panel and are suitable to be accordion-folded in a spaced apart manner so as to receive and retain the base of the article between them. The end retainers permit visual inspection through a carton open end of at least a portion of the interior of the carton which is inward of the end retainers.

In another aspect, there is provided a blank for the open-ended carton described above. In the blank, a tray panel is hingedly connected along a first longitudinal score line to a brace flap and is cut and scored to provide a pair of end retainers. A first side panel is hingedly connected along a second longitudinal score line to a side of the tray panel, opposite the brace flap. A top panel is hingedly connected along a third longitudinal score line to the first side panel opposite the tray panel, and a second side panel is hingedly connected along a fourth longitudinal score line to the top panel, opposite the first side panel. A bottom panel is hingedly connected along a fifth longitudinal score line to the second side panel, opposite the top panel. Means are provided for connecting each of the end retainers to the brace flap and to the first side panel for assisting in holding the end retainers in an upright position when the retainers are accordion-folded.

The front and rear end retainers limit the end-wise movement of an article disposed between them. The other panels of the blank are folded and fit closely around the sides and top of the article to hold the article in the tray and to protect it. The bottom panel is folded to underlie and support the tray panel.

In an especially preferred form, a glue flap can be provided on the side edge of the bottom panel to make securing the blank around the article easier. Also, means can be provided which connect the end retainers to the brace flap and to the first side panel to assist in holding the end retainers upright.

In one form, each end retainer comprises four portions. An outer floor portion is adjacent to an outside edge of the tray panel and has an inside edge which is hingedly connected to an outer wall portion. The outer wall portion is folded upwardly from the floor portion and has an upper edge which is hingedly connected to an inner wall portion. The inner wall portion is folded downwardly and is connected at its lower edge to an inner floor portion which underlies an edge of the base of the article. This embodiment can also be provided with a tongue which is cut out of the outer wall portion and is connected to the outer floor portion so that it can underlie the inner floor portion and provide an extra thickness of packaging material.

The present invention provides a savings in packaging material by obviating the need for end walls and shipping spacers and by allowing the use of a rectangular shaped blank (which reduces waste material in fabrication from raw sheet stock). The resulting open-ended carton reveals the article and its condition before and after each particular handling operation. This gives notice that it should be handled carefully, and reveals any damage that might occur during the operation. Responsibility for breakage is therefore much easier to assess, and breakage is reduced. Moreover, the article is held securely in place.

It is therefore a principal object of the invention to provide an open-ended carton with an integral tray for holding an enclosed article in place.

It is another object of the invention to provide a carton which conserves packaging material.

It is another object of the invention to provide a carton blank which is easily manufactured and constructed into a carton.

It is another object of the invention to provide a carton which reveals its contents and any breakage to prospective handlers.

The foregoing and other objects and advantages of the invention will appear in the following detailed description. In the description, reference is made to the accompanying drawings which show, by way of illustration and not limitation, a preferred embodiment of the invention.

BRIEF DESCRIPTION OF THE DRAWINGS

FIG. 1 is a perspective view of a portion of a partially folded blank of the present invention;

FIG. 2 is a perspective view of the blank of FIG. 1 further folded around a toilet;

FIG. 3 is an end view in elevation of the blank of FIG. 2 which is completely folded around a toilet to provide a carton of the present invention;

FIG. 4 is a view partially in section taken on the line 4—4 of FIG. 3;

FIG. 5 is a reduced top plan view of the unfolded blank of FIG. 2;

FIG. 6 is a detail view of the lower left portion of the carton shown in FIG. 4;

FIG. 7 is a detail view of the lower right portion of the carton shown in FIG. 4;

FIG. 13 is a side view of the carton of FIG. 9 with a portion broken away.

DETAILED DESCRIPTION OF THE PREFERRED EMBODIMENTS

Figure 8:
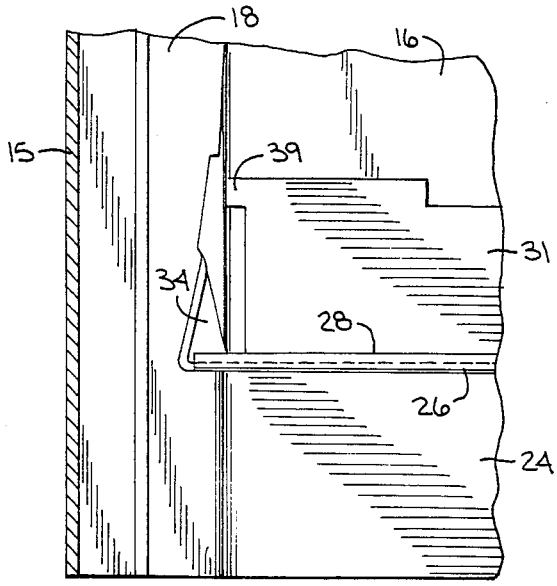
FIG. 8 is an enlarged fragmentary view taken on the line 8—8 of FIG. 3.
Figure 10:
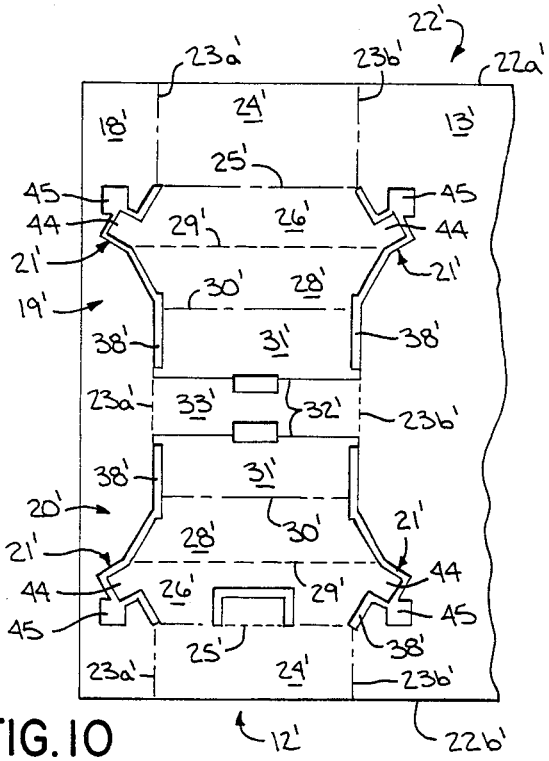
FIG. 10 is a top plan view of a portion of a blank for the carton of FIG. 9.

Referring to FIGS. 1–3, a carton 10 is shown in various stages of being wrapped around a toilet 11. While the invention is especially adapted for heavy, fragile articles like toilets, it could, of course, be used with any articles.

Carton 10 can be made from many types of known folding board, provided the material is capable of withstanding the loads to which the particular carton is to be subjected. Typical examples suitable for toilets include corrugated cardboard or a foldable plastic sheet material. If corrugated cardboard is used, a double face corrugate is preferable for its added strength and cushioning.

As best shown in FIG. 3, the carton 10 fits closely around the top, sides and base of the toilet 11. A tray panel 12 which is about as wide as the base of the toilet 11 extends under the base and is connected along one edge to a first side panel 13. The first side panel 13 extends upwardly across the side of the toilet 11 and terminates near the top edge of the toilet. A top panel 14 extends from edge to edge across the top of the toilet 11 and connects the top edge of the first side panel 13 to the top edge of a second side panel 15. The second side panel 15 extends across the side of the article opposite the first side panel 13 and is connected at its lower edge to a bottom panel 16 which extends under the bottom of the tray panel 12 to support the tray panel.

An optional glue flap 17 is provided along the edge of the bottom panel 16 opposite the second side panel 15 to make securing the carton around the toilet 11 easier. This flap also provides an extra layer of cushioning around the base of the toilet. Also, a brace flap 18 is attached along the side edge of the tray panel 12 opposite the first side panel 13 to provide an extra layer of cushioning for the base of the toilet 11 and to serve other purposes which will be described below.

The top of the toilet 11 is wider than its base so that carton 10 is trapezoidally shaped. However, the carton 10 need not be trapezoidal. The top of the toilet 11 might also be as wide as or wider than its base. If it were, the carton 10 would either be rectangular or upright trapezoidally shaped. Regardless of the shape of the toilet, the close fit of the carton around the sides, top and bottom of the toilet helps restrain movement of the toilet within the carton without the need for extra spacers.

FIG. 4 shows how the toilet 11 is restrained from end-wise movement within the carton 10. The toilet base is received between a front end retainer 19 and a rear end retainer 20. The end retainers 19 and 20 are integral with the tray panel 12 and are accordion-folded into an upright position. The close fit of the carton 10 holds the toilet 11 down between the end retainers 19 and 20 to limit the end-wise movement of the toilet within the carton. This obviates the need for end walls. As an added measure against end-wise movement of the toilet 11, means 21 are provided to hold the end retainers upright against outward forces exerted on them by the toilet.

A cut and scored blank 22 from which the carton 10 is constructed is shown in FIG. 5. The open-ended construction of the carton 10 allows the blank 22 to be rectangular. Each panel of the blank 22 is also rectangular, having lateral edges 22*a, b* along the front and rear edges of the blank 22, and being hingedly connected to adjacent panels by longitudinal score lines 23*a, b, c, d, e* and *f* which are indicated by broken lines. Cut lines are represented by solid lines.

The tray panel 12 deserves particular attention since it is the panel that includes the end retainers 19 and 20. Each end retainer has an outer floor portion 24 which is adjacent to the respective front 22*a* or rear 22*b* lateral edge of the tray panel 12. The inside edge of each outer floor portion 24 is hingedly connected by a lateral score line 25 to an outer wall portion 26. Each outer wall portion 26 has angled side edges along score lines 27. The inside edge of each outer wall portion 26 is hingedly connected to an inner wall portion 28 by another lateral score line 29. The side edges of each inner wall portion 28 are also cut at an angle. These angles and those created by lines 27 conform to the trapezoidal shape of the carton.

Another lateral score line 30 connects the inside edge of each inner wall portion 28 to an inner floor portion 31 having straight-cut side edges. A lateral cut line 32 along the inside edge of each inner floor portion 31 separates each inner floor portion from a central web 33 which is disposed between the two end retainers 19 and 20.

In the embodiment of FIGS. 1–8, each means 21 for holding the end retainers upright includes a triangular web 34 which connects the side edge of each outer wall portion 26 to the adjacent brace flap 18 (or on the other side to the first side panel 13). In this regard, each triangular web 34 is hingedly connected by one of the score lines 27 to a side edge of the outer wall portion 26. As viewed in FIG. 5, the triangular web 34 connects the left side edge of each outer wall portion 26 to the brace flap 18 and the right side edge to the first side panel 13 by an angled score line 35.

Narrow spaces 38 are provided along the cut edges of the triangular webs 34, the inner wall portion 28 and the inner floor portion 31. These spaces 38 provide clearance for the end retainers 19 and 20 to be folded easily. However, the spaces 38 terminate slightly outward from the cut line 32. This provides a pair of ears 39 on the ends of the inner floor portion 31 which serve to hold each end retainer flat within the tray panel 12 during shipment, storage and handling of the blank 22. Also, a handle 40 is cut out between the inner floor portion 31 and the central web 33 so that the inner floor portion 31 can be easily grasped by a human packer to fold the end retainer into position.

The end retainers 19 and 20 are identical, one being the mirror image of the other with one exception. The rear end retainer 20 differs from the front end retainer 19 because the rear of the toilet base is undercut as shown by a hidden line 41 in FIG. 3. The rear end retainer 20 is therefore provided with a tongue 42 which is cut out of the outer wall portion 26. A space 43 is provided along the three-sided periphery of the tongue 42 (which is within the outer wall portion 26) so that the outer wall portion can be folded easily relative to the tongue. Also, the score line 25 need not extend across the tongue 42 since the tongue 42 is not folded. The tongue 42 remains in the plane of the tray panel 12 as the rear end retainer 20 is folded and takes up the space between the undercut area 41 and the bottom panel 16 to provide additional cushioning and support to the rear of the toilet base.

The blank 22 is folded as follows to provide the carton 10. The first side panel 13 and the brace flap 18 are folded upwardly and the end retainers 19 and 20 are grasped by the handle cut-outs 40 and also folded upwardly along the score lines 25. Each triangular support web 34 will fold back over its adjacent brace flap 18 or first side panel 13, and will end up in the position best shown in FIGS. 6, 7 and 8 when the outer wall portion 26 is at about a 90° angle with respect to the outer floor portion 24. Each inner wall portion 28 is then folded downwardly along the score line 29 about 180°. It is then positioned between the triangular webs 34.

In this position, each triangular web 34 abuts against the adjacent side edge of each inner wall portion 28 (see FIG. 8) and supports the outer wall portion 26 to hold the end retainers 19 and 20 upright. Each inner floor portion 31 is then folded about 90° inwardly so that it lays approximately in or parallel to the plane of the outer floor portion 24. When the first side panel 13 and the brace flap 18 are folded so that the end retainers 19 and 20 are in position as shown in FIG. 1, the toilet base is placed between the end retainers. The rear of the toilet base is placed adjacent to the rear end retainer 20 on top of the inner floor portion 31. As best shown in FIGS. 4 and 6, the tongue 42 then underlies the inner floor portion 31 of the rear end retainer 20 so that when the toilet base is placed on top of the support portion 31, the tongue 42 takes up the space created by the undercut 41 at the rear of the toilet base. The central web 33 supports the center of the toilet base and the front of the base is supported by the inner floor portion 31 of the front end retainer 19.

It may be desirable to make the end retainer folding operation easier if a stiff folding board material is used. This can be accomplished by providing a portion of the various lateral score lines as a cut line. For example, the middle portions of the score lines 29 could be provided as cut lines to make folding the inner wall portion 28 relative to the outer wall portion 26 easier.

The carton 10 is completed by folding the top panel 14 over the top of the toilet 11 and folding the second side panel 15 downwardly toward the toilet base as best shown in FIG. 2. The bottom panel 16 is folded to underlie the tray panel 12, and the glue flap 17 is folded up along the first side panel 13. It is then stapled, glued or otherwise secured thereto. Though the glue flap 17 provides an extra layer of cushioning and makes securing the carton 10 around the toilet bowl 11 easier, it is optional. If the glue flap 17 were deleted, the bottom panel 16 could be secured directly to the tray panel 12 or by some other suitable means.

FIGS. 9–13 show a second embodiment of the invention which is generally referred to as carton 10' and blank 22'. Carton 10' is constructed essentially the same as carton 10 except that different means 21' are provided on the ends of the outer wall portions 26' to cooperate with the brace flap 18' and the first side panel 13' to hold the end retainers 19' and 20' upright. Tabs 44 are provided on the edges of the outer wall portions 26'. Just as the material for the triangular webs 34 is provided by the adjacent flap 18 or panel 13 in the first embodiment, the material for the tabs 44 is provided by the adjacent flap 18' or the panel 13'. The narrow spaces 38' are extended around the tabs 44 and the side edges of the outer wall portions 26' up to the lateral score lines 25'. This construction requires that the side edges of the outer and inner wall portions 26' and 28', respectively, be slightly more angled and extend a distance into the adjacent brace flap 18' and first side panel 13' to conform to the trapezoidal shape of the carton 10' in their upright positions. Also, cut-outs 45 are provided in the brace flap 18' and the first side panel 13' and are aligned with tabs 44 when the end retainers are folded into position.

Figure 11:
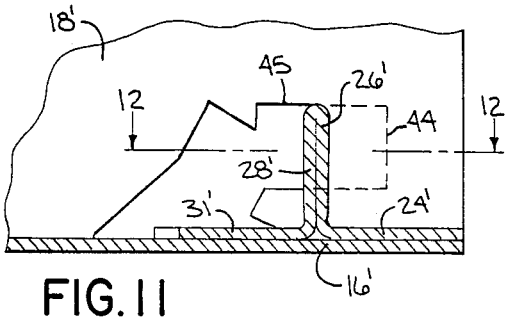
FIG. 11 is an enlarged fragmentary view taken on the line 11—11 of FIG. 9.
Figure 12:
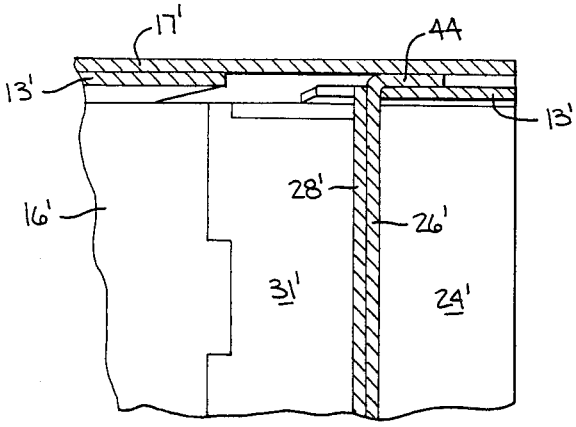
FIG. 12 is a fragmentary view taken on the line 12—12 of FIG. 11.

As in the first embodiment, the end retainers 19' and 20' and the brace flap 18' and the first side panel 13' are folded to cooperate with one another to hold the end retainers upright. As the portions of each end retainer are folded to assume their accordion-folded relationship to one another, the adjacent brace flap 18' and first side panel 13' are folded upwardly so that tabs 44 enter cutouts 45. As shown in FIGS. 11–13, the outer edges of the cut-outs 45 are positioned so that when the tabs 44 abut the outer edges, the end retainers 19' and 20' are in an upright position. The tabs 44 are then folded back against their adjacent brace flap 18' or first side panel 13' to hold the flap 18' and panel 13' closely adjacent to the angled edges of the outer and inner wall portions 26' and 28' of each end retainer.

Figure 9:
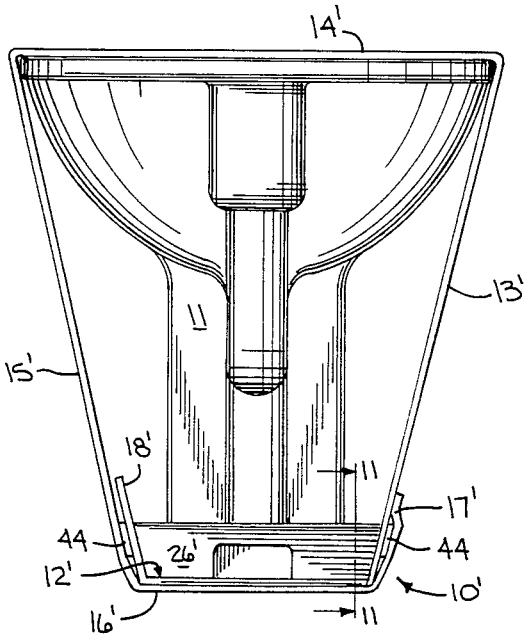
FIG. 9 is an end view in elevation of a second embodiment of the invention.

As best shown in FIG. 9, the second side panel 15' and the glue flap 17' sandwich the folded-back tabs 44 to maintain their folded-back relationship with respect to the brace flap 18' and to the first side panel 13'. Note that if the glue flap 17' were deleted in this embodiment, the two tabs 44 which are folded back along the first side panel 13' (see FIG. 13) could be secured in their folded-back positions by gluing, stapling or some other means.

Both embodiments conserve packaging labor and materials. The open-ended construction results in a minimum number of seams which must be secured in constructing the carton. It also obviates the need for end walls and shipping spacers to thereby conserve packaging materials. The rectangular blank used to construct the carton further conserves packaging materials by reducing waste in fabricating the blank from raw sheet stock.

Another important advantage of a shipping carton of the invention is that it reduces the likelihood of shipping damage to the toilet. The toilet is plainly visible to a prospective handler through the open ends of the carton. By seeing the fragile contents of the carton, the handler is put on notice that the carton should be handled with care. If it is not handled with care and damage results, the damage will be readily visible so that the responsibility for the damage can be accurately and assuredly assigned.

It will be apparent to those skilled in the art that various modifications to the preferred embodiment in addition to those mentioned above are possible without departing from the spirit or scope of the invention. For example, the tongue 42 could be eliminated. On the other hand, a tongue 42 could be provided for each of the front and rear end retainers. Also, it may be desirable to protect the enclosed article from dust by sealing the ends of the carton with a transparent material or by sealing the article within a transparent bag before packing it in the carton. Therefore, the scope of the invention is not to be limited only to the description of the preferred embodiments above.

I claim:

1. An open-ended shipping carton for an article, comprising:

a brace flap;

a tray panel suitable to extend across the base of the article from a first side to a second side, a side edge of said tray panel adjacent to the second side being connected to the brace flap;

a first side panel connected to a side edge of the tray panel adjacent to the first side, said first side panel being suitable to extend across the first side of the article from the base to the top of the article;

a top panel connected to the first side panel adjacent to a top edge of the first side panel, said top panel being suitable to extend across the top of the article from the first side to the second side;

a second side panel connected to a side edge of the top panel adjacent to the second side, said second side panel being suitable to extend across the second side of the article from the top to the base of the article;

a bottom panel that is suitable to extend under the bottom of the tray panel from the second side toward the first side, is connected to the second side panel adjacent to its bottom edge, and is secured so that the carton is suitable to fit around the top, first and second sides, and base of the article;

a pair of end retainers formed by cuts and fold lines in the tray panel which are suitable to be accordion-folded in a spaced apart manner so as to receive the base of the article between them; and support means unitarily connecting the side edges of each of the end retainers to the brace flap and to the first side panel for assisting in holding the end retainers in an upright position to secure the base of the article between them.

2. A shipping carton as in claim 1, wherein each end retainer comprises:

an outer floor portion adjacent to a lateral edge of the tray panel and in the plane of the tray panel;

an outer wall portion connected to an inside edge of the outer floor portion and folded upwardly from the outer floor portion;

an inner wall portion connected to the upper edge of the outer wall portion and folded downwardly from the outer wall portion; and an inner floor portion connected to the lower edge of the inner wall portion and suitable to be folded to underlie an edge of the base of the article; and wherein the support means for assisting in holding the end retainers in an upright position are connected to side edges of the outer wall portions.

3. A shipping carton as in claim 2, wherein at least one of the end retainers has a tongue which is formed from a cut out of the outer wall portion and which underlies the inner floor portion so as to be suitable to cushion and support the base of the article.

4. A shipping carton as in claim 3, further comprising a glue flap which is connected to a side edge of the bottom panel adjacent to the first side and which extends over at least a portion of the first side panel.

* * * * *